US005106103A

United States Patent [19]

Fiore

[11] Patent Number: 5,106,103

[45] Date of Patent: Apr. 21, 1992

[54] INITIAL GAME

[76] Inventor: Janine Fiore, 3644 N. New England, Chicago, Ill. 60634

[21] Appl. No.: 620,738

[22] Filed: Dec. 3, 1990

[51] Int. Cl.[5] ..... A63F 9/00; A63F 9/04

[52] U.S. Cl. ..... 273/459; 273/145 C; 273/146

[58] Field of Search ..... 273/459, 145 R, 145 A, 273/145 C, 144 R, 144 A, 144 B, 146, 272, 299

[56] References Cited

U.S. PATENT DOCUMENTS

| | | | |
|---|---|---|---|
| 1,512,147 | 10/1924 | Tegtmeyer et al. | 273/272 |
| 1,781,983 | 11/1930 | Koch | 273/145 C |
| 2,249,079 | 7/1941 | Garrett | 273/145 C |
| 2,739,815 | 3/1956 | Fay | 273/145 C |
| 3,116,927 | 1/1964 | Kuhlman | 273/272 |
| 3,724,847 | 4/1973 | Compton | 273/145 C X |
| 4,004,811 | 1/1977 | Brandin | 273/299 |
| 4,026,558 | 5/1977 | Patlin | 273/299 X |
| 4,084,816 | 4/1978 | Shafer | 273/299 X |
| 4,164,351 | 8/1979 | Baker | 273/146 X |
| 4,306,725 | 12/1981 | Sawyer | 273/299 X |
| 4,509,758 | 4/1985 | Cole | 273/145 C X |
| 4,690,409 | 9/1987 | Scalia | 273/299 |

FOREIGN PATENT DOCUMENTS

| | | | |
|---|---|---|---|
| 1281020 | 11/1961 | France | 273/146 |

*Primary Examiner*—William H. Grieb

*Attorney, Agent, or Firm*—Hill, Van Santen, Steadman & Simpson

[57] ABSTRACT

A board game providing a random letter selection tray holding a plurality of cubes, each cube displaying at least one letter, the plurality of cubes is shaken in the tray displacing the cubes randomly, whereupon after shaking ceases the letters fall into two columns divided into a plurality of rows. The game players must independently recognize known persons who correspond to the randomly selected initials read across the two columns by individual rows and mark down the persons on each players's game card. The game is timed and multiple players compete with the score based on the number of famous personage which each player can match to the randomly selected initial groupings. Alternate embodiments provide for balls to replace cubes, and cubes having a plurality of different letters, one letter on each face of each cube.

24 Claims, 2 Drawing Sheets

FIG. 4
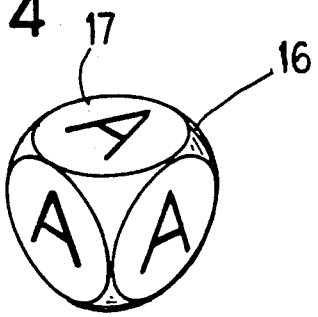
FIG. 5
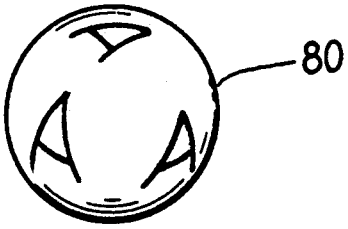
FIG. 7
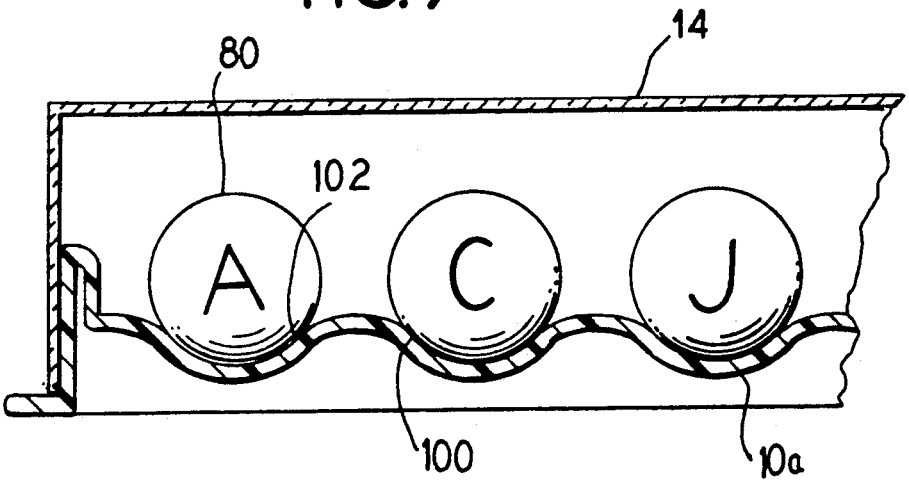
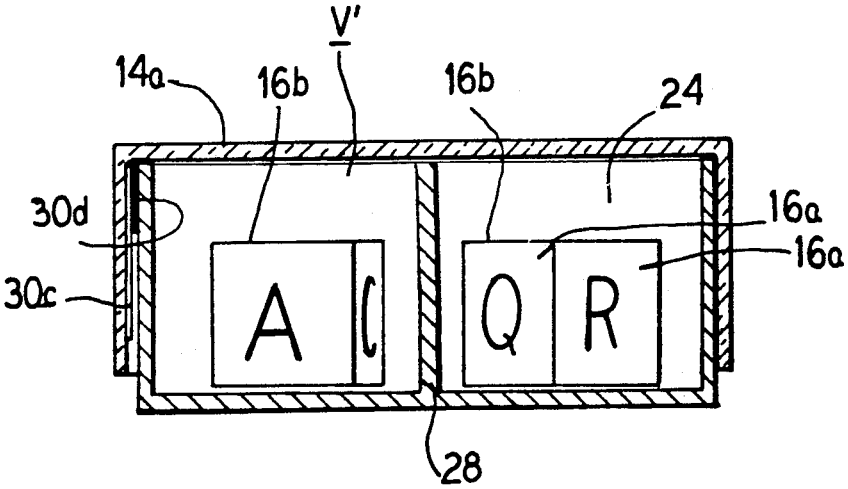
FIG. 8
FIG. 6
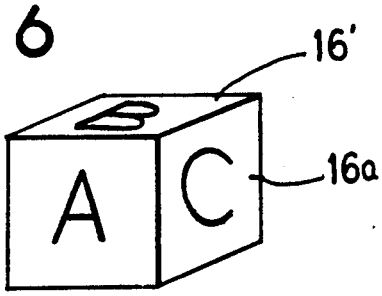

INITIAL GAME

BACKGROUND OF THE INVENTION

1. Field of the Invention

The present invention relates to play at home board games, in particular, the present invention relates to a trivia-type game utilizing the initials of known or famous people.

2. The Prior Art

U.S. Pat. No. 4,690,409 to Scalia discloses a game where randomly selected letters are rearranged by the player to form abbreviations, acronyms or initials recognizable by that player. The method of selecting the random letters is disclosed to be by a pivotable pointer on a dial. In this game the player is free to rearrange the letters to form the selectable abbreviations, acronyms or initials.

U.S. Pat. No. 4,084,816 discloses a complex card game which has as its task the spelling out of words on a drawn word card.

U.S. Pat. No. 4,004,811 discloses a word game using lettered objects, letter selection devices and combination boards, and a set of rules, suitable for audience entertainment, testing and comparing the luck and skill of participants in drawing random combinations of lettered objects which consecutively or in rearranged order form recognized words. Rewards of fixed size and chances at further rewards of variable sizes are won by obtaining letters in consecutive order and, if no consecutive word order is obtained, for rearranging letters into word order., the rewards, either points or case or prizes, increasing for words formed from greater numbers of letters. Alphabetical orders of letters drawn may also be recognized and rewarded.

U.S. Pat. No. 4,306,725 discloses a card game using educational cards and a spin dial for selecting various letters. Random words or initials are not a part of the game.

U.S. Pat. No. 4,026,558 discloses a word forming game utilizing lettered tiles. The tiles are selected by players from a shuffled pile.

SUMMARY OF THE INVENTION

The present invention, the "Initial Game" is an inexpensive board game most suited for at-home family competition, although such application is not the limit of the invention, television "game show" use and other use is encompassed by the invention. A means is provided for randomly selecting and displaying a plurality of letters, grouped in pairs, such as a plurality of objects having letters thereon which interfit randomly into a grid, forming a letter matrix. The objects can be cubes or balls having a single letter displayed thereon or alternatively, the plurality of cubes can have multiple different letters on each cube, with a different letter on a plurality of faces. A typical cube would thus have six letters thereon, most of the letters, or all of the letters, different. However, in the basic form of the gave each cube or ball would have a single letter.

Alternatively, the means for selecting can be spinning pointers on a dial, playing cards, other mechanical devices, or an electronic display.

The preferred embodiment of the game comprises a cube tray having two parallel columns comprising a plurality of rows. The two columns are configured to receive the cubes or balls in subcompartments similar in configuration to a rectangular ice cube tray. A tray hood is provided to interfit over the tray and provide a volume for shaking and intermixing the cubes or balls dislocated from the subcompartments. The cubes or balls can thus be shaken out of their subcompartments in the volume bounded by the hood and the tray, and upon termination of the shaking, the cubes or balls would resettle into random subcompartments in a random fashion.

In another embodiment of the game, the tray can be a surface with concave indentations and the objects can be balls. This configuration aids the insertion of the balls into random indentations in the surface.

Other variations include providing compartments which hold two cubes or balls therein instead of single cube or ball subcompartments, or providing that each cube or rounded cube comprises a variety of letters thereon and shaking of the tray rearranges such cubes or balls as to a visible face thereon, but the balls or cubes do not exit subcompartments during shaking.

Basically, the object of the game is to identify famous people whose initials correspond to the randomly selected initials which are paired on the tray grid such as read across the two columns, row by row.

BRIEF DESCRIPTION OF THE DRAWINGS

FIG. 4 is a perspective view of a rounded cube shown in FIG. 1;

FIG. 5 is a perspective view of a letter ball;

FIG. 6 is a perspective view of a squared cube;

FIG. 7 is a longitudinal sectional view of an alternative embodiment of the selection tray of FIG. 2; and FIG. 8 is a lateral sectional view of a second alternate embodiment of the selection tray of FIG. 2.

DETAILED DESCRIPTION OF THE PREFERRED EMBODIMENTS

Figure 1:
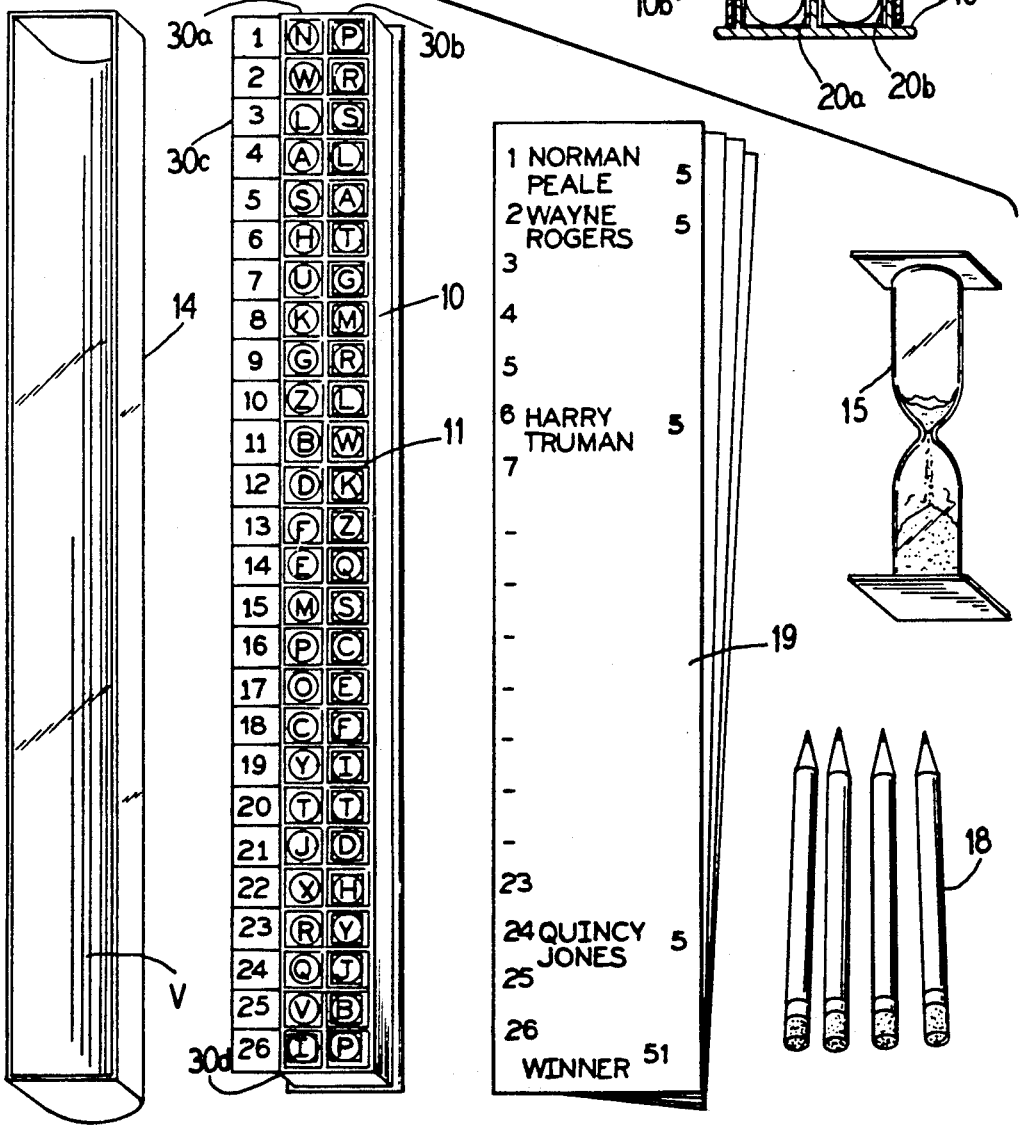
FIG. 1 is an exploded view of component parts to the present invention.

FIG. 1 shows the parts to the game. Shown are the selection tray 10 with a hood 14 separated therefrom, and an egg-type timer 15. The purpose of the hood 14 is to provide a volume V openable to an open face 11 of the tray 10 wherein the cubes 16 can be shuffled or shaken and then randomly deposited into compartments 20 of the tray 10. The hood 14 can be a bulged out lid. The compartments 20 each hold two cubes 16. A separate holder could just as well be provided to shake the cubes therein, wherefrom the cubes 16 could be allocated onto the open face 11 of the tray 10. Pencils 18 and game cards 19 are auxiliary items assisting in the playing of the game. The hood 14 (and a lid 14*a*, discussed hereinafter) can be transparent or opaque and removable for letter recognition.

The hood 14, if transparent, can be fixed to the selection tray 10.

In a simple embodiment of the invention, 52 cubes 16 are utilized which interfit into 26 compartments 20 or 52 subcompartments 20*a*, 20*b*. Excess cubes 16 can also be utilized during the shaking operation which are not received into the compartments 20 or subcompartments 20*a*, 20*b*. Only those cubes 16 which are received by the subcompartments constitute the letter matrix for initial recognition by the players. Along with the tray and hood, the Initial Game can further comprise game cards for the players to write down their selected personage which corresponds to the initials, and an egg-type timer for limiting the duration of each game.

It is clear that the number of compartments 20 being 26 is an arbitrarily selected number and other numbers of compartments would work equally well provided that enough letters are utilized to provide a wide variety of random two letter initial groupings. Having 26 compartments 20 with 52 subcompartments 20*a*, 20*b* is logical as it provides for two cubes or balls allocated for each letter of the alphabet.

Figure 2:
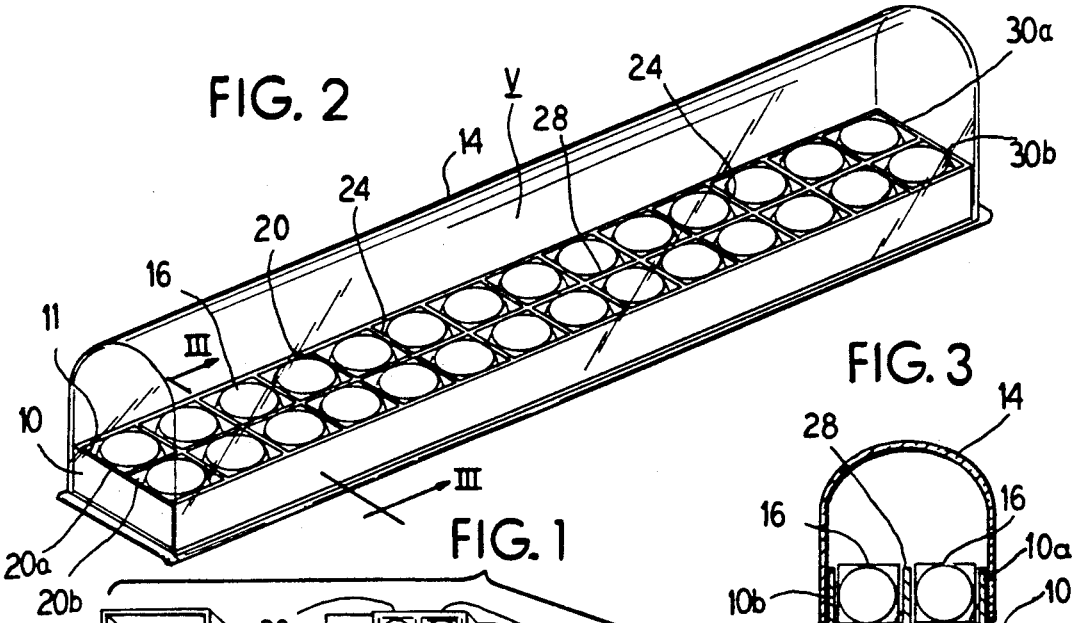
FIG. 2 is a perspective view of a selection tray of the present invention.

FIG. 2 shows the selection tray 10 having the open face 11 with randomly arranged cubes 16 therein, and a hood 14 installed onto the selection tray 10. For simplicity the cubes 16 are shown blank in FIG. 2, the cubes 16 would according to the invention have letters displayed thereon as per FIG. 1. The selection tray 10 comprises a rectangular elongate box-like structure with rectangular compartments 20 formed by a plurality of widthwise partitions 24. Each compartment 20 holds two cubes 16. A lengthwise partition 28 can be utilized to divide each compartment into left and right subcompartments 20*a*, 20*b* for holding the cubes 16 in a left and right orientation. The lengthwise partition 28 forms a first column 30*a* and a second column 30*b* of subcompartments. Adjacent and attached to the first column 30*a* is a numerical indicia column 30*c* labeled with numbers corresponding to each compartment or row. This indicia column 30*c* can be connected along a side of the tray 10 in a hinged fashion along the hinge 30*d* which runs a length of the indicia column 30*c*. Its purpose is to fix a reference number to each compartment or row which corresponds to a reference number on a game card 48 held by each player. The indicia column 30*c* can be folded down when the hood 14 covers the tray 10, as shown in FIG. 8.

The completed game card 19 corresponding to the arrangement of cubes 14 in FIG. 1. It is readily apparent that a particular player who filled out the game card 19 was able to match known personage to four initial groupings of letters corresponding to compartments numbered 1, 2, 6 and 24.

When the game begins the cubes 16 are shuffled and randomly arranged into the tray 10 forming a letter matrix. All of the players begin simultaneously and independently to ascertain known personage who's initials match up with the letters displayed across each compartment. The players mark such personage on their individual game cards 19 at a point on the game card 19 corresponding to the compartment indicia from the indicia column 30*c* on the tray 10. Where more than one player chooses the same person having initials corresponding to the particular compartment or row of cubes 16, a lesser amount of points are granted to each player who chose that personage; thus rewarding unique selection of personage. After a predetermined period, monitored by the egg timer 15, the cards 19 are examined and points allotted rewarding the player who ascertains the highest number of persons corresponding to the randomly selected initials displayed in the compartments of the letter matrix.

After a predetermined number of rounds the points are tallied and a winner declared.

Of course it is possible to alter the rules of the game such as:

(1) having only one player or only one team of players play with a randomly selected letter matrix, a second player or team of players would thereafter shuffle and then play with a new matrix, thus an extra element of luck is introduced depending on the particular letters dealt to the individual player or team; or (2) rewarding rather than penalizing players for choosing personage corresponding to a particular set of initials which matches personage chosen by other players, thus an element of chance is introduced whereby players attempt to choose based on what they perceive their opponents would choose; or (3) when letters are grouped by pairs, allowing the letters to be used in any order, i.e., an "AB" grouping could be matched by "Anne Brown" or "Bill Arnold"; or (4) limiting the personage eligible to be matched with the letters to a limited group such as entertainers, sports personalities, baseball players, singers, college classmates, etc.

Figure 3:
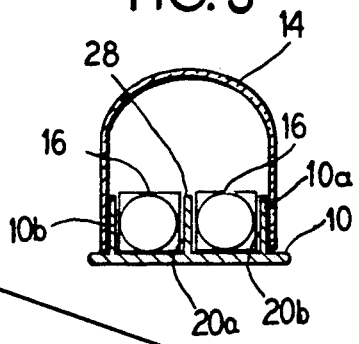
FIG. 3 is a sectional view taken generally along line III—III of FIG. 2.

FIG. 3 discloses the hood 14 to have a rounded rectangular configuration, arched upward. Other configurations of the hood 14 are possible. The cubes 16 residing in the subcompartments 20*a*, 20*b* are rounded cubes as more clearly shown in FIG. 4. The hood 14 is shown interfitting over the tray 10, in gripping engagement on the outside of walls 10*a*, 1O*b*. This resilient gripping engagement prevents unwanted spillage of the cube 16 during storage and the like.

FIG. 4 shows the cube 16 being visualized as either a rounded squared-off cube or a round ball having flats 17 positioned at six places in typical cube face formation. In the shown cube 16 of FIG. 4 the letter "A" is displayed on all flats 17, however as described hereinafter an alternate embodiment of the game would provide for a variety of letters displayed on each cube 16, with one letter per flat 17.

FIG. 5 discloses an alternate embodiment of the cube 16 which is a letter ball 80 having at least one letter displayed thereon. As with the cube 16 a variety of letters can be displayed on the letter ball 80 depending on the embodiment of the invention. The letter ball 80 is particularly suited to the embodiment shown in FIG. 7.

FIG. 6 shows a conventional cube 16' having a variety of letters displayed on its face 16*a*. The conventional cube 16' can of course be utilized in the game as described in FIGS. 1-3.

FIG. 7 shows an alternate embodiment of the tray 10 wherein an alternate tray 10*a* is utilized. The alternate tray 10*a* has a surface 100 having concave indented regions 102 which are adapted to receive one letter ball 80 therein, centered in the region 102. The balls 80 can be therefore randomly allocated into other regions 102 by shaking or gyrating the surface 100. In this embodiment smooth and efficient distribution of the initials throughout the surface is enhanced.

As FIG. 8 demonstrates, if each cube 16 of the arrangement in FIG. 1 has a variety of different letters thereon, one letter on each face, simply shaking the tray 10 will produce a substantially different random letter matrix without individual cubes 16 leaving each compartment. Thus the hood 14 can be fashioned as a lid 14*a* to prevent cubes 16 from leaving individual compartments, the cubes 16 would simply be shuffled inside each compartment 20, or subcompartments 20*a*, 20*b* where provided, to display a randomly selected upper face 16*b* facing upwardly of the open face 11 of the tray. The lengthwise partition 28 and the widthwise partition 24 extend upward close to the lid 14a to prevent movement of cubes 16 between compartments 20 or subcompartments 20a, 20b. The lid 14a forms a volume V' with the tray 10 above each cube 16', to permit random rearrangement of the upper face 16b for each cube, in each compartment 20 or subcompartment 20a, 20b. The lid can be periodically lifted to reshuffle cubes into different compartments 20 or subcompartments 20a, 20b. This method prevents unwanted jamups of cubes or uneven distribution of the cubes from the lid into the compartments.

The tray 10 and the hood 14 can comprise known materials such as plastic.

Although the present invention has been described with reference to a specific embodiment, those of skill in the art will recognize that changes may be made thereto without departing from the scope and spirit of the invention as set forth in the appended claims.

I claim as my invention:

1. A board game comprising:

a plurality of cubes, each having a plurality of faces, each face displaying one letter;

a selection tray having compartments for receiving two of said cubes recessed inside each compartment, said compartments aligned in a column, each of said compartments displaying a fixed unique numerical indicator; and a hood mounted onto said selection tray, capturing the cubes between said selection tray and said hood and providing a volume for randomly mixing said plurality of cubes for relocation of said cubes into randomly selected compartments; and a game card having numerical indicators corresponding to the numerical indicators for said compartments, said game card having blank areas arranged adjacent each numerical indicator for transcribing an answer corresponding to the displaying letters located in each said compartment.

2. A board game comprising:

52 cubes, each cube having a plurality of faces, each cube having only one letters displayed on each of its faces, with two cubes corresponding to each letter of the alphabet;

a selection tray having 26 compartments for receiving two of said cubes recessed inside each compartment, said compartments aligned in a column; and a hood mounted onto said selection tray, capturing the cubes between said selection tray and said hood and providing a volume for randomly mixing said plurality of cubes for relocation of said cubes into randomly selected compartments.

3. A board game according to claim 2, wherein said hood is transparent and fixed to said selection tray.

4. A board game according to claim 2, wherein said hood is removably captured on said selection tray, and said hood is opaque, so that said randomly selected cube arrangement in said compartments is not visible to an observer until said hood is removed from said selection tray.

5. A board game according to claim 1, wherein each said cube comprises a variety of different letters arranged one letter on each of said faces of each said cube.

6. A board game according to claim 1, wherein each said compartment is divided into two subcompartments, each subcompartment sized to hold one cube therein.

7. An apparatus for use in a game among a plurality of players in which randomly selected letters are matched to initials of known persons, comprising:

a means of randomly selecting and displaying a plurality of random two letter groupings providing a letter matrix, each said two letter grouping designated with an identifying marking; and a means of recording a player's positive response to each grouping, said means of recording allocating a space corresponding to each said identifying marking for inputting a player's positive response, said positive response being an identification and matching of a particular grouping under consideration by the player of a known person's name having initials which match the two letter grouping under consideration.

8. An apparatus according to claim 7, wherein said means of randomly selecting and displaying comprises:

a container divided into a plurality of compartments open on one face side toward the players;

a plurality of objects having at least one letter indicia on each object, said plurality of objects displaying a plurality of different letters, each said compartment having at least one recess for receiving two of said objects into one of said compartments, said compartments visually segregating said objects into said two letter groupings; and means for randomly shuffling said plurality of objects to display a randomly selected matrix of letters arranged in said two letter groupings.

9. An apparatus according to claim 8, wherein said means for randomly shuffling comprises an enclosed volume openable to said compartments, said objects receivable into said volume, said volume large enough to randomly mix said objects when said volume is shaken, said volume communicating said objects outward therefrom into randomly selected compartments.

10. An apparatus according to claim 9, wherein said container comprises an elongated tray divided into two columns having a plurality of rows, each said compartment comprises two subcompartments each holding one object therein, each compartment corresponding to a single row.

11. An apparatus according to claim 10, wherein said enclosed volume comprises a bulged out lid to said tray, providing a shuffling volume above said compartments.

12. An apparatus according to claim 11, wherein said objects are rectangular cubes.

13. An apparatus according to claim 12, wherein said objects have on each object a plurality of different letters.

14. An apparatus according to claim 10, wherein said objects are spherical.

15. An apparatus according to claim 14, wherein said subcompartments are concave indentations in said tray, and said objects can roll into said subcompartments.

16. An apparatus according to claim 8, wherein said objects comprise cubes, each cube having at least two different letters displayed on a sum of six faces of each cube, one letter on each face; and said means for randomly shuffling comprises a lid covering said one face side of said compartments, a volume bounded by each said compartment and said lid sized to allow each said cube to be shaken and rearrange itself with a randomly selected face exposed toward said one face side.

17. An apparatus according to claim 16, wherein said lid prevents said cubes from moving between compartments.

18. An apparatus according to claim 17, wherein a plurality of said cubes each have a different letter on each face.

19. An apparatus according to claim 18, wherein said lid is bulged over each compartment to provide an individual separated volume above each compartment for shaking cubes residing in each compartment.

20. A method of playing a game between at least two players comprising the following steps:

a) provide a means for repeatably randomly selecting and displaying a plurality of two letter groupings;

b) provide a tally sheet having a designated space corresponding to each grouping;

c) actuate said means to display said plurality of groupings;

d) said players simultaneously and independently proceed to match each of said two letter grouping to initials of a person selected from a group of people belonging to a preselected database, and record said person on said tally sheet in said designated space provided for each two letter grouping;

e) after a predetermined time limit said players reveal said tally sheets to all players;

f) for each player, record a predetermined positive score value for each grouping wherein said player successfully matches a person's initials to each said grouping;

g) tally each player'score values to determine the winner of the game.

21. A method according to claim 20 comprising the further step of:

h) where more than one player has selected the same person for a particular grouping, award a second predetermined positive score for that grouping for all those who chose said same person, instead of said first predetermined positive score.

22. A method according to claim 21, wherein said second predetermined positive score is less than said first predetermined positive score.

23. A method according to claim 20, wherein each of said randomly selected letter groupings are displayed in a particular order, with a first letter and a second letter, and said players match said groupings to said person having a first initial and a last initial corresponding to said first letter and said second letter respectively.

24. A board game comprising:

a selection tray having a column of compartments disposed in lateral rows and corresponding in number to at least the number of coded indicia in a datum reference alphabet;

a hood mounted onto said selection tray, and providing a volume beneath said hood and said selection tray;

a plurality of cubes corresponding in number to the number of compartments and with each face of the cube bearing an indicia selected from the coded indicia in the datum reference alphabet, whereby said cubes can be shuffled and shaken under said hood and then randomly deposited in said compartments, said selection tray having a numerical columnar indicia-bearing means on one side of said tray and being labeled with numbers corresponding to each lateral row, and disposed in columnar alignment with said rows of compartments whereby a random indicia couple of said cubes is selectively displayed opposite each number on said indicia-bearing means in a randomly created indicia matrix; and a game card having a numerical columnar indicia corresponding to that of said indicia-bearing means for recording answers matching the coupled indicia on the cubes.

* * * * *